United States Patent [19]

Tsukamoto

[11] 4,282,042

[45] Aug. 4, 1981

[54] WIRE ROD STEEPING EQUIPMENT

[76] Inventor: Kotoro Tsukamoto, 7-8, Kashima 4-chome, Yodogawa-ku, Osaka, Japan

[21] Appl. No.: 829,863

[22] Filed: Sep. 1, 1977

[51] Int. Cl.[3] ..... B08B 3/04; B08B 9/02

[52] U.S. Cl. ..... 134/140; 134/160; 134/170

[58] Field of Search ..... 134/140, 160, 164, 170, 134/83, 133-134, 165

[56] References Cited

U.S. PATENT DOCUMENTS

| | | | |
|---|---|---|---|
| 1,208,727 | 12/1916 | Barley | 134/164 X |
| 1,755,719 | 4/1930 | Williams | 134/160 |
| 1,801,063 | 4/1931 | Williams | 134/160 |
| 1,820,851 | 8/1931 | Trevorrow | 134/160 X |
| 2,651,313 | 9/1953 | Toennies | 134/133 |

*Primary Examiner*—Robert L. Bleutge

*Attorney, Agent, or Firm*—Wenderoth, Lind & Ponack

[57] ABSTRACT

A wire rod steeping apparatus has at least one elongated tank, a rotary shaft extending along one side of the tank, and a drive motor and reduction gear connected to the shaft for driving the rotary shaft in opposite rotational directions. A plurality of chain wheels are spaced along the length of the shaft, and chains having their one ends connected to and extending from the wheels droop into the tank and have the other ends connected to the opposite side of the tank from the side along which the shaft extends. A plurality of slanting frames are positioned in the tank spaced at intervals therealong and have slanting members slanting upwardly from the side of the tank along which the shaft extends to the opposite side of the tank, the chains drooping below the slanting members when the chains are fully extended.

2 Claims, 1 Drawing Figure

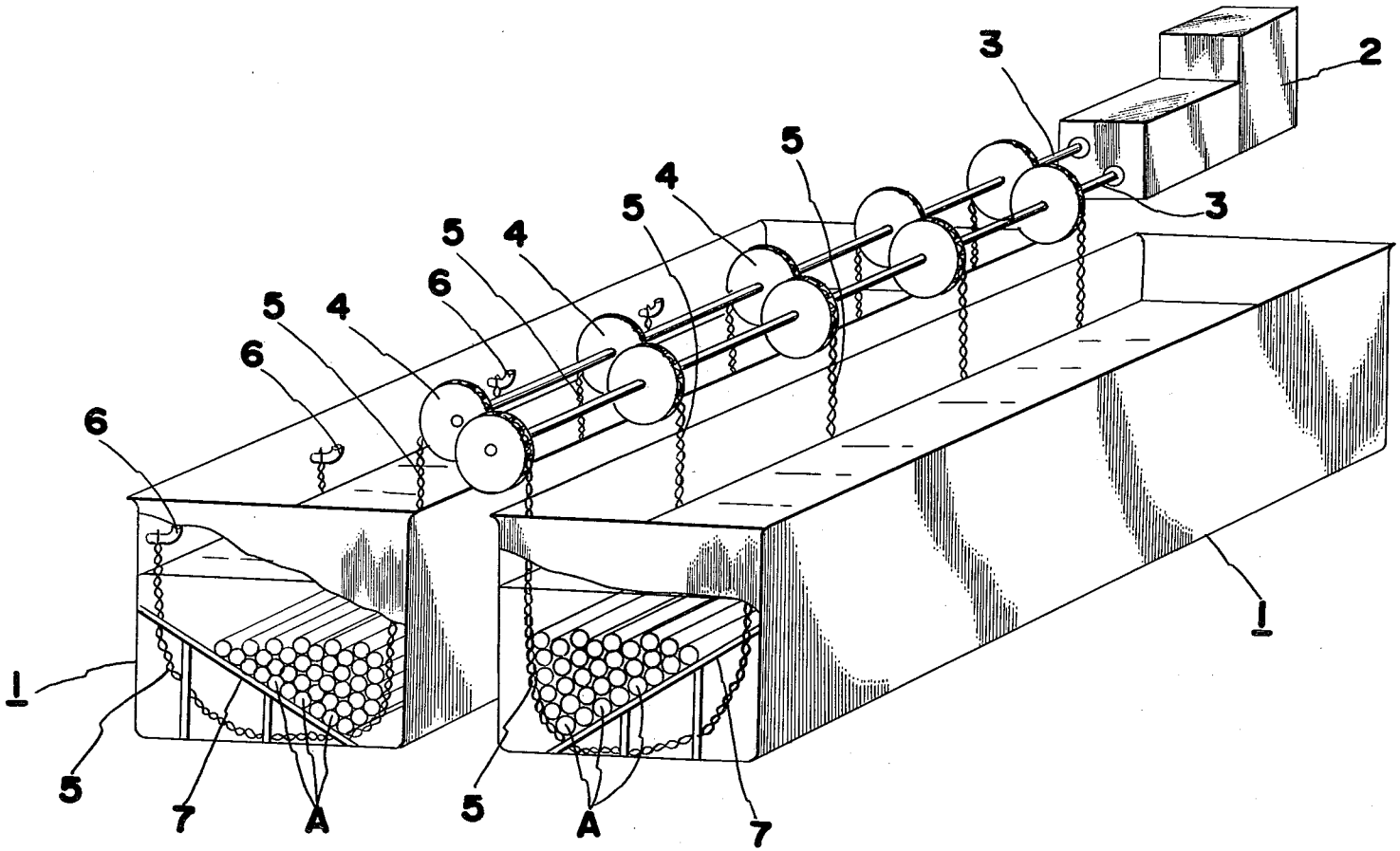
2
3
3
1
5
4
5
4
5
6
4
5
6
6
7
A
5
A
7
5
1

WIRE ROD STEEPING EQUIPMENT

The present invention relates to equipment for cleaning the rough surfaces of wire rods preliminary to the process of drawing, etc.

Generally, the wire rods delivered from the makers to the fabricators have to be preliminarily processed for removing corrosion on the rod surface before drawing and subsequent working. For this reason, the wire rods are soaked in a tank of dilute sulfuric acid or dilute hydrochloric acid to dissolve and remove surface corrosion and other matter, i.e. the so-called process of steeping.

However, the conventional method of steeping is merely to soak a plurality of rods, bundled and hung on a crane, in a tank of steeping liquid and, therefore, a long time is required before corrosion and other matter are removed and moreover, because the acid fails to reach the parts where the rods are in contact with each other such parts often remain corroded.

The primary object of the present invention is to provide steeping equipment which overcomes the drawbacks in conventional types of equipment.

The secondary object of the present invention is to provide steeping equipment for wire rods which is capable of efficiently performing the cleaning work by moving the bundled wire rod up and down while they are held horizontally.

The tertiary object of the present invention is to provide steeping equipment capable of cleaning all surfaces of all wire rods in a bundle by moving them up and down while they are positioned horizontally within the steeping tank and by rolling and turning them so that their mutually contacting parts are exposed to the acid.

BRIEF DESCRIPTION OF THE DRAWING

The invention will now be described in connection with the attached drawing, which is a perspective view of the steeping apparatus according to the invention showing bundles of wire rods being steeped in tanks of acid.

The steeping apparatus according to the present invention comprises an acid tank 1 in which the wire rods "A" are to be steeped. A motor and gear means 2 drive a rotary shaft 3 normally and reversely, the rotary shaft 3 extending horizontally along one edge of the tank 1. Chain wheels 4 are mounted on the rotary shaft 3 at intervals therealong and chains 5 having one ends fixed to the chain wheels 4 extend into the tank and have the other ends connected to the hooks 6 on the side wall of the tank 1 on the opposite side from the shaft 3. The chains 5 normally droop down to the bottom of the tank 1. A plurality of slanting frams 7 are mounted at intervals along the bottom of the tank 1, and are inclined from the one side along which the shaft 3 is located upwardly toward the opposite side of the tank. The lowest wire rods A rest on the frames in a horizontal position.

In actual practice it is preferred that two tanks 1 be placed side by side with a single motor and gear means

2 driving the shafts 3 for both tanks, as shown in the FIGURE.

In operation, when bundles of wire rods "A", transported to and lowered into the tanks 1 by crane, are stepped in the acid in the tanks 1, the lowest rods in the bundles lie horizontally on the frames 7 with the other rods more or less horizontally positioned on top of them. The power is switched on for the motor of the means 2 and the rotary shafts 3 are turned in a direction to wind the chains 5 up on the chain wheels 4 to lift the wire rods in the tank on the stretched chains 5. The chain wheels 4 are driven in the direction to wind the chains 5 up, they are driven in the opposite direction to loosen the chains 5. The actions of lifting and lowering the wire rods are repeated. When the bundle of wire rods A is raised and lowered, the wire rods are rotated or tumbled and therefore the parts of contact of the rods are mutually changed and all surfaces of all rods are evenly washed by the acid.

By the steeping apparatus of the present invention as above described, by tightening and loosening the chains the wire rods in the bundles are alternately moved up and down in the steeping tank to give rotational movement to each rod which does not allow acid to remain in continuous contact with the rods, but rather the rods are constantly in contact with fresh liquid to thus shorten the steeping time. As the arrangement changes the mutual contacting parts of rods due to their rotation, all surfaces of all rods are evenly cleaned and no stains are left on the contacting sections—the process being highly efficient as compared to the conventional method of keeping the rod bundles static in the steeping tank.

What is claimed is:

1. A wire rod steeping apparatus comprising an elongated tank, a rotary shaft extending along one side of the tank, a drive means connected to said shaft for driving said rotary shaft in opposite rotational directions, a plurality of chain wheels spaced along the length of said shaft, chains having their one ends connected to and extending from said wheels and drooping into said tank and having the other ends connected to the opposite side of the tank from the side of the tank along which said shaft extends, and a plurality of slanting frames fixed in said tank spaced at intervals therealong and having slanting members slanting upwardly from the side of the tank along which said shaft extends to the opposite side of the tank, said chains drooping below said slanting members when the chains are fully extended.

2. A wire rod steeping apparatus as claimed in claim 1 further comprising a second tank parallel to said first-mentioned tank, second rotary shaft along said second tank on the side closest to said first mentioned tank, chain wheels and chains on said second rotary shaft and slanting frames fixed in said second tank, said drive means being connected to said second rotary shaft for driving said second rotary shaft in opposite rotational directions.

* * * * *